US007525519B2

(12) United States Patent
Chang et al.

(10) Patent No.: US 7,525,519 B2
(45) Date of Patent: Apr. 28, 2009

(54) ELECTRON EMISSION DEVICE, DISPLAY DEVICE USING THE SAME, AND DRIVING METHOD THEREOF

(75) Inventors: Cheol-Hyeon Chang, Suwon-si (KR); Sang-Hyuck Ahn, Suwon-si (KR); Su-Bong Hong, Suwon-si (KR); Sang-Jo Lee, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 600 days.

(21) Appl. No.: 11/136,934

(22) Filed: May 25, 2005

(65) Prior Publication Data

US 2005/0264229 A1 Dec. 1, 2005

(30) Foreign Application Priority Data

May 28, 2004 (KR) ..... 10-2004-0038165

(51) Int. Cl.
*G09G 3/20* (2006.01)

(52) U.S. Cl. ..... 345/75.2; 315/169.1

(58) Field of Classification Search ..... 345/74.1, 345/75.2, 204, 76; 313/495–497, 292, 311, 313/209, 258, 422, 308; 315/169.1–169.4; 445/23, 25, 50, 51

See application file for complete search history.

(56) References Cited

U.S. PATENT DOCUMENTS

| | | | | |
|---|---|---|---|---|
| 5,781,169 | A * | 7/1998 | Kuijk et al. | 345/82 |
| 6,608,620 | B1 * | 8/2003 | Suzuki et al. | 345/204 |
| 6,633,287 | B1 * | 10/2003 | Yatabe et al. | 345/211 |
| 6,873,309 | B2 * | 3/2005 | Suzuki et al. | 345/76 |
| 7,038,393 | B2 * | 5/2006 | Murakata et al. | 315/169.3 |
| 2001/0015615 | A1 * | 8/2001 | Xia | 313/495 |
| 2004/0090398 | A1 * | 5/2004 | Takeuchi et al. | 345/75.2 |
| 2004/0164931 | A1 * | 8/2004 | Han et al. | 345/60 |

FOREIGN PATENT DOCUMENTS

CN 1355523 A 6/2002

* cited by examiner

*Primary Examiner*—Amr Awad
*Assistant Examiner*—Stephen G Sherman
(74) *Attorney, Agent, or Firm*—Christie, Parker & Hale, LLP

(57) ABSTRACT

An electron emission device includes a first electrode having a data signal applied thereto, a second electrode having a scan signal applied thereto, an electron emitter for emitting electrons in response to a voltage difference between the data signal and the scan signal, and a third electrode having a focusing signal for focusing the electrons emitted from the electron emitter. In the electron emission device, an off-voltage of the scan signal is set lower than an on-voltage of the data signal.

20 Claims, 7 Drawing Sheets

ELECTRON EMISSION DEVICE, DISPLAY DEVICE USING THE SAME, AND DRIVING METHOD THEREOF

CROSS REFERENCE TO RELATED APPLICATION

This application claims priority to and the benefit of Korean Patent Application No. 10-2004-0038165 filed on May 28, 2004 in the Korean Intellectual Property Office, the entire content of which is incorporated herein by reference.

BACKGROUND OF THE INVENTION

1. Field of the Invention

The present invention relates to an electron emission device. More specifically, the present invention relates to an electron emission device with improved image quality, a display device using the same, and/or a driving method thereof.

2. Description of the Related Art

Electron emission devices use a hot cathode or a cold cathode as an electron source. Known examples of electron emission devices using a cold cathode are field emitter array (FEA), surface conduction emitter (SCE), metal-insulator-metal (MIM), metal-insulator-semiconductor (MIS), and ballistic electron surface emitting (BSE) electron emission devices.

The FEA electron emission device is a device based on the functional principle that when a material having a low work function and/or a high beta (β) function is used as an electron source, electrons are readily emitted from the material under a vacuum by an electric field difference. A tip structure of molybdenum (Mo) or silicon (Si), or a carbon material such as graphite or DLC (Diamond Like Carbon) has been used as an electron source for the FEA electron emission device. Recently, electron emission devices using nano-materials such as nano-tubes and/or nano-wires as an electron source have also been developed.

The SCE electron emission device has a conductive film formed between first and second electrodes arranged opposing each other on a first substrate. A minute gap (or crack) is provided in the conductive film to form an electron emitter. The SCE electron emission device is based on the principle that the minute gap, i.e., the electron emitter, emits electrons when a voltage is applied to the first and second electrodes to make a current flow to the surface of the conductive film.

The MIM electron emission device and the MIS electron emission device have as their electron emitters a metal-insulator-metal (MIM) structure and a metal-insulator-semiconductor (MIS) structure, respectively. These electron emission devices emit electrons based on the principle that a voltage applied between two metals or between a metal and a semiconductor, with an insulator interposed between them, moves or accelerates electrons from the metal or the semiconductor having the higher electron potential to the metal having the lower electron potential.

The BSE electron emission device includes an electron supply layer formed from a metal or a semiconductor on an ohmic electrode, and an insulating layer and a metal film formed on the electron supply layer. This electron emission device emits electrons by the power applied to the ohmic electrode and the metal film based on the principle that electrons can be moved without being scattered when the size of the semiconductor is reduced to a range smaller than the average free stroke of the electrons.

In general, an above-described electron emission device includes an anode electrode formed on a second substrate, to which the anode electrode is applied with a high voltage having a positive voltage level, so as to cause electrons emitted from the electron emitter to collide with a phosphor formed on the second substrate.

The conventional electron emission devices are, however, problematic in that unselected pixels emit a light by a high positive voltage applied to the anode electrode. Namely, an electric field (hereinafter also referred to as "anode field") formed around the electron emitter by the high positive voltage applied to the anode electrode causes the electron emitter to improperly emit electrons that collide with an unintended phosphor area, and hence causes a unwanted light emission on the second substrate. The unwanted light emission caused by the anode electrode can be referred to as a "diode emission."

Also, even if the electrons are properly emitted, the conventional electron emission devices are problematic in that the electrons of the electron emitter can collide with a phosphor in an undesired area without being properly concentrated (or focused), to thereby cause a distortion of the image with a deterioration of the image quality.

SUMMARY OF THE INVENTION

It is an aspect of the present invention to provide an electron emission device and an associated driving method, in which the electron emission device can shield an anode field to eliminate a diode emission and/or can concentrate an electron beam emitted from an electron emitter to minimize image distortion.

In one embodiment of the present invention, an electron emission device includes a first electrode having a data signal applied thereto, a second electrode having a scan signal applied thereto, and an electron emitter for emitting electrons in response to a voltage difference between the data signal and the scan signal. In this embodiment, an off-voltage of the scan signal is set lower than an on-voltage of the data signal.

In one embodiment of the present invention, an electron emission device includes a panel, a data driver, and a scan driver. The panel includes a first substrate having a plurality of scan and data electrodes arranged to intersect with each other and an electron emitter formed therewith, and a second substrate having at least one anode electrode formed therewith. The data driver applies data signals having first and second voltages to the data electrodes. The scan driver applies a third voltage to selected ones of the scan electrodes and a fourth voltage to unselected ones of the scan electrodes. The electron emitter emits electrons caused by the difference between the first voltage applied to the data electrodes and the third voltage applied to the selected ones of the scan electrodes. The fourth voltage is set lower than the first voltage.

In one embodiment of the present invention, a method for driving an electron emission device is provided. The electron emission device includes a first substrate having at least one anode electrode formed therewith, and a second substrate having a plurality of first electrodes, a plurality of second electrodes with an electron emitter formed thereon, and a third electrode formed over the first electrodes. In the method, (a) the first electrodes are sequentially selected to apply a first voltage in a first interval and a second voltage in a second interval; (b) a data voltage is applied to the second electrodes; and (c) a third voltage is applied to the third electrode during (a) and (b). The second voltage is set to a voltage level for causing the first electrodes to shield an electric field of the anode electrode in the second interval.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF THE EXEMPLARY EMBODIMENTS

Figure 1:
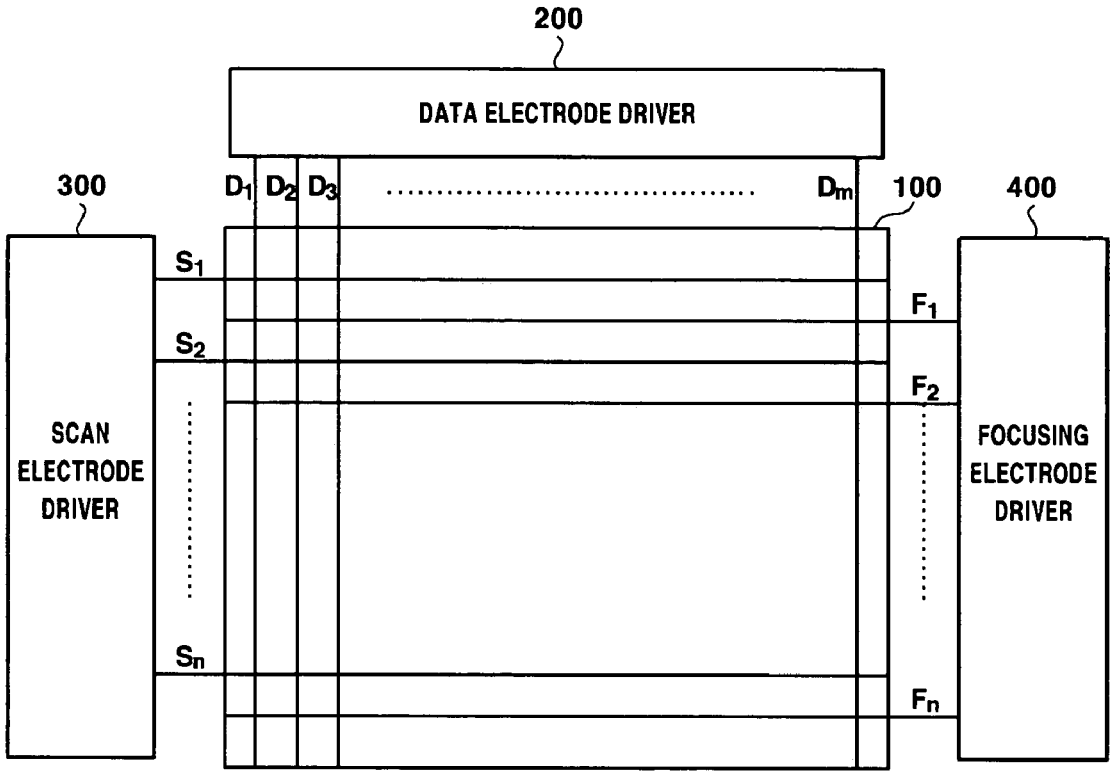
FIG. 1 is a schematic of a display device using an electron emission device according to an embodiment of the present invention.

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, and not restrictive.

There may be parts shown in the drawings, or parts not shown in the drawings, that are not discussed in the specification as they are not essential to a complete understanding of the invention. Like reference numerals designate like elements. When it is stated that a first component is coupled to a second component, the first and second components may be coupled directly to each other or a third component may be positioned between the first component and the second component.

FIG. 1 is a schematic of a display device using an electron emission device according to an embodiment of the present invention.

As shown, the display device of FIG. 1 includes a display panel 100 for displaying an image; a data electrode driver 200 for driving data electrodes D1 to Dm; a scan electrode driver 300 for driving scan electrodes S1 to Sn; and a focusing electrode driver 400 for driving focusing electrodes F1 to Fn.

The display panel 100 includes a plurality of data electrodes D1 to Dm arranged in a first direction (e.g., a column direction); a plurality of scan electrodes S1 to Sn; and a plurality of focusing electrodes F1 to Fn. The scan electrodes S1 to Sn and the focusing electrodes F1 to Fn are alternatively arranged in a second direction (e.g., a row direction). The scan electrodes S1 to Sn are intersecting (or crossing over) the data electrodes D1 to Dm, and a plurality of pixels are formed at the intersections (or the crossings) of the data electrodes D1 to Dm and the scan electrodes S1 to Sn.

The data electrode driver 200 supplies one or more data signals to the data electrodes D1 to Dm, and the scan electrode driver 300 supplies one or more scan signals to the scan electrodes S1 to Sn.

According to an embodiment of the present invention, the scan electrode driver 300 sequentially selects the scan electrodes S1 to Sn and applies scan pulses (or signals) to the selected scan electrodes S1 to Sn. The data electrode driver 200 applies one or more data voltages to the data electrodes D1 to Dm while the scan pulses are being applied.

The focusing electrode driver 400 applies one or more negative voltages to the focusing electrodes F1 to Fn to focus an electron beam emitted from an electron emitter (not shown) and to shield an anode field, thereby preventing a diode emission.

Figure 2:
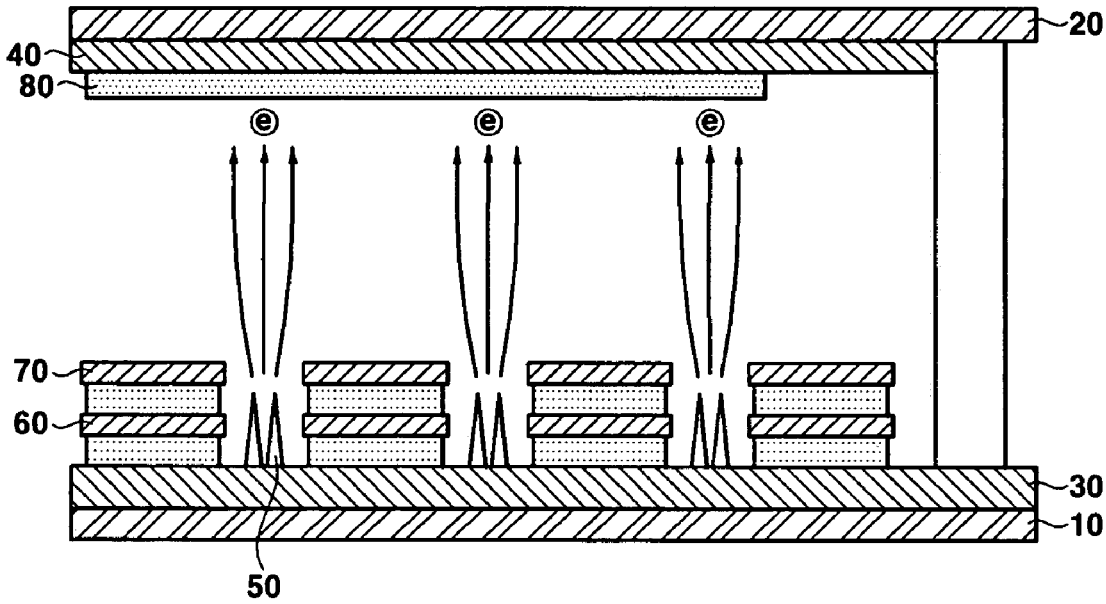
FIG. 2 is a cross-section of an electron emission device according to an embodiment of the present invention.

FIG. 2 is a cross-section of an electron emission device according to an embodiment of the present invention.

The electron emission device of FIG. 2 includes a back substrate 10 and a front substrate 20. A cathode electrode 30 is formed on the back substrate 10; an insulating layer is interposed between the cathode electrode 30 and a first gate electrode 60; and another insulating layer is interposed between the first gate electrode 60 and a second gate electrode 70. An electron emitter 50 is formed on the cathode electrode 30.

The front substrate 20 has a surface facing the back substrate 10. On the surface of the front substrate 20 facing the back substrate 10 are formed a phosphor 40 for causing collision of electrons to display an image, and an anode electrode 80 for attracting electrons emitted from the electron emitter 50.

In operation, the electron emission device of FIG. 2 focuses a high electric field on the electron emitter 50 by a voltage applied between the cathode electrode 30 and the first gate electrode 60 and hence causes the electron emitter 50 to emit electrons by a quantum-mechanical tunnel effect. The electrons emitted from the electron emitter 50 are accelerated at the voltage applied to the anode electrode 80 and are collided with the phosphor 40 to cause light emission of the phosphor 40.

In FIG. 2, the first gate electrode 60 is shown to be formed on the cathode electrode 30 with the insulating layer interposed therebetween, but the invention is not thereby limited. For example, the first gate electrode 60 can be formed under the cathode electrode 30 according to an embodiment, in which case the electron emitter 50 is formed on the first gate electrode 60.

Also, in FIG. 2, the phosphor 40 is shown to be formed on the entire surface of the substrate 20, with the anode electrode 80 formed on the phosphor 40, but the invention is not thereby limited. For example, a transparent anode electrode can be formed on the entire surface of the substrate 20, with the phosphor 40 formed on the transparent anode electrode, according to an embodiment. In this case, a metal film can also be formed on the phosphor 40.

Hereinafter, a driving method for a display device using an electron emission device according to an embodiment of the present invention will be described in detail.

In the following description, the cathode electrode 30 is used as a data electrode Dm, and the first gate electrode 60 is used as a scan electrode Sn, but the present invention is not thereby limited. For example, the cathode electrode 30 can be used as any one or more of the data electrodes D1 to Dm, and the first gate electrode 60 can be used as any one or more of the scan electrodes S1 to Sn. In addition, depending on the electrode configuration of the electron emission device, the cathode electrode 30 can be used as the scan electrode Sn, and the first gate electrode 60 can be used as the data electrode Dm. The driving method can be modified accordingly as known to those skilled in the art.

In addition, a scanning voltage applied to a selected scan electrode can be referred to as an "on-voltage of the scan signal", and a scanning voltage applied to an unselected scan electrode can be referred to as an "off-voltage of the scan signal." A voltage applied to a data electrode to turn on the pixels can be referred to as an "on-voltage of the data signal", and a voltage applied to a data electrode to turn off the pixels can be referred to as an "off-voltage of the data signal."

Figure 3:
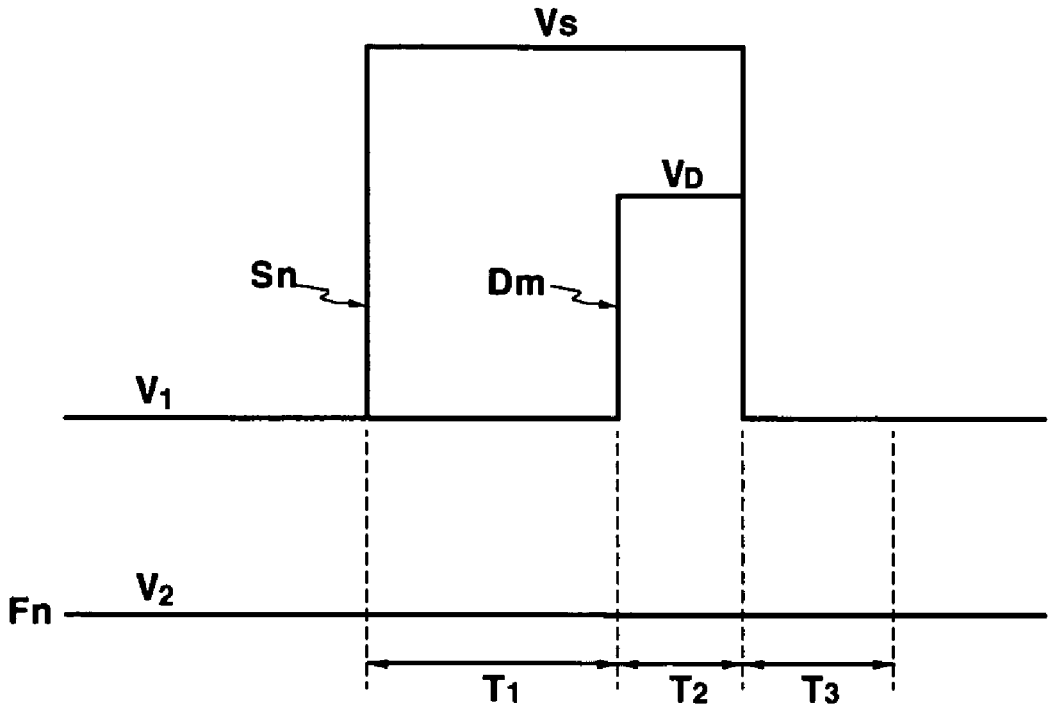
FIG. 3 is a driving waveform diagram of a display device according to a first embodiment of the present invention.

FIG. 3 is a driving waveform diagram of a display device according to a first embodiment of the present invention.

In interval T1, an on-voltage VS of the scan signal is applied to the scan electrode Sn, and an on-voltage V1 of the data signal is applied to the data electrode Dm. The voltage difference VS−V1 between the scan electrode Sn and the data electrode Dm causes the electron emitter 50 to emit electrons, which then collide with the phosphor 40 to turn on the pixels.

In interval T2, an off-voltage VD of the data signal is applied to the data electrode Dm, with the on-voltage VS of the scan signal to the scan electrode Sn being sustained. The reduced voltage difference VS−VD between the scan electrode Sn and the data electrode Dm interrupts electron emission of the electron emitter 50 to turn off the pixels.

In interval T3, an off-voltage V1 of the scan signal is applied to the scan electrode Sn, with the off-voltage VD of the data signal being applied to the data electrode Dm, to turn off the pixels. The voltage V1 is then later applied to the data electrode Dm. Here, the off-voltage V1 of the scan signal is equal to the on-voltage V1 of the data signal and is usually set to 0 V.

In FIG. 3, the second gate electrode 70 can be used as an focusing electrode Fn (or any one or more of the focusing electrodes F1 to Fn). A negative voltage V2 is continuously applied to the focusing electrode Fn to focus the electron beam from the electron emitter 50 on the phosphor 40 of a desired position in the interval T1 and to shield a high positive electric field of the anode electrode 40 in the intervals T2 and T3, thereby preventing a diode emission.

An increase in the magnitude of the negative voltage applied to the focusing electrode Fn may enhance the electric field shielding function as well as the focusing function, but reduces the number of electrons moved to the anode electrode 40, thereby deteriorating the brightness of the display panel 100.

Therefore, an adequate negative voltage that is not too high or too low should be applied to the focusing electrode Fn. The electric field caused by the anode electrode 40 can be shielded by increasing either the film thickness of the second gate electrode 70 used as the focusing electrode Fn or the aspect ratio (depth/width) of the hole in which the electron emitter 50 is formed. However, a fabrication process for such an electron emission device is very complicated and causes many problems in the aspect of productivity and yield.

Accordingly, in a second embodiment of the present invention, a diode emission on unselected pixels is prevented by setting the off-voltage of the scan signal lower than the on-voltage of the data signal.

Figure 4:
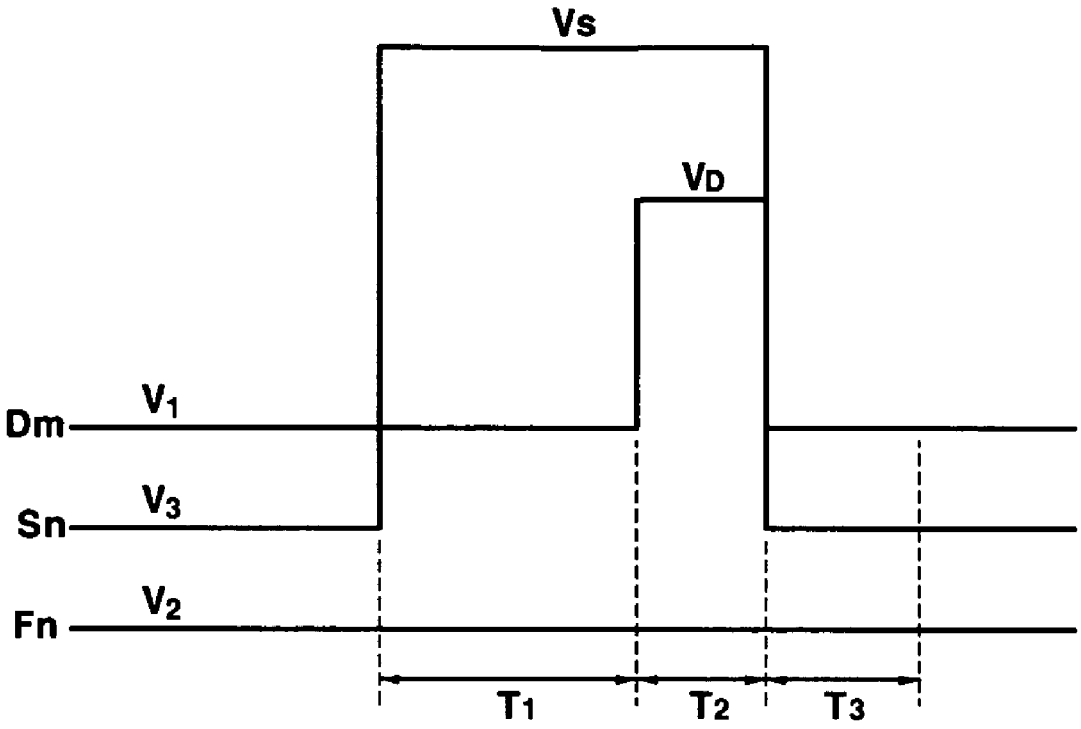
FIG. 4 is a driving waveform diagram of a display device according to a second embodiment of the present invention.

In more detail, FIG. 4 illustrates a driving waveform diagram of a display device according to the second embodiment of the present invention.

The second embodiment of the present invention is different from the first embodiment in that the off-voltage of the scan signal is lowered to a voltage V3.

By setting the off-voltage V3 of the scan signal lower than the on-voltage V1 of the data signal, unselected scan electrodes (e.g., one or more of the scan electrodes S1 to Sn) prevent unintended electron emission of the electron emitter 50, and the focusing electrodes (e.g., one or more of the focusing electrodes F1 to Fn) shield an electric field of the anode electrode 40.

More specifically, in interval T1, an on-voltage VS of the scan signal is applied to the scan electrode Sn, and the on-voltage V1 of the data signal is applied to the data electrode Dm. The voltage difference VS−V1 between the scan electrode Sn and the data electrode Dm causes the electron emitter 50 to emit electrons, which then collide with the phosphor 40 to display an image.

In interval T2, an off-voltage VD of the data signal is applied to the data electrode Dm, with the on-voltage VS of the scan signal applied to the scan electrode Sn being sustained. The voltage difference VS-VD between the scan electrode Sn and the data electrode Dm decreases to interrupt electron emission of the electron emitter 50.

In interval T3, the off-voltage V3 of the scan signal is applied to the scan electrode Sn, with the off-voltage VD of the data signal being applied to the data electrode Dm. The voltage V1 is then later applied to the data electrode Dm. Here, the voltage V3 applied to the scan electrode Sn is lower than the voltage V1 applied to the data electrode Dm, so the scan electrode Sn shields an electric field of the anode electrode 40. Namely, when the first gate electrode 60 is used as the scan electrode Sn, with the cathode electrode 30 used as the data electrode Dm, the first gate electrode 60 shields a high voltage applied to the anode electrode by applying a voltage lower than the voltage applied to the cathode electrode 30 to the first gate electrode 60 of unselected pixels to which the off-voltage of the scan signal is applied.

Accordingly, a diode emission caused by the anode field can be substantially prevented by a first shielding of the anode field on unselected pixels with the focusing electrodes F1 to Fn and a second shielding of the anode field with the scan electrodes S1 to Sn.

In this second embodiment, no diode emission has to occur even when a higher voltage is applied to the anode electrode 40 than in the first embodiment, thereby increasing the voltage that can be applied to the anode electrode 40 to enhance the brightness of the image. This reduces a distortion of the image caused by the diode emission to improve the image quality of the display device.

Figure 5:
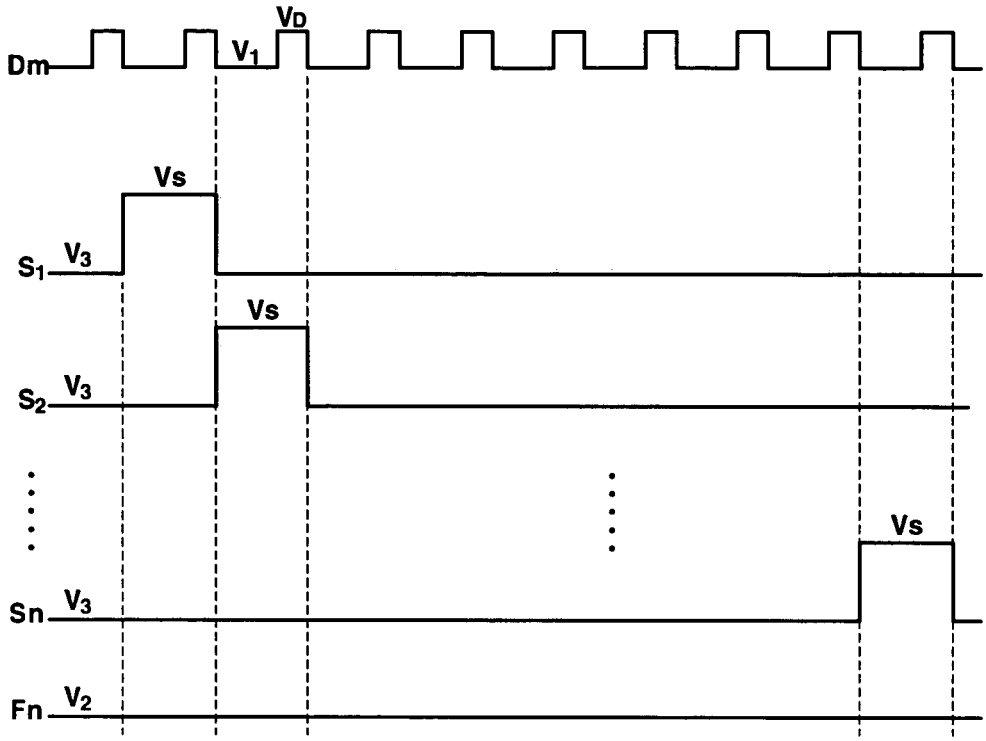
FIG. 5 is a more complete driving waveform diagram of the display device according to the second embodiment of the present invention.

FIG. 5 is a more complete driving waveform diagram of the display device according to the second embodiment of the present invention.

Referring to FIG. 5, the on-voltage VS of the scan signal is sequentially applied to the scan electrodes S1 to Sn and sustained during a pixel selection time. The off-voltage V3 of the scan signal is applied when the selection time ends.

The off-voltage V3 of the scan signal is set lower than the on-voltage V1 of the data signal, so a diode emission on unselected pixels can be prevented.

Hereinafter, reference will be made to FIGS. 6 and 7 so as to describe the shielding effect of an anode field in the driving method according to the first and second embodiments. The graphs of FIGS. 6 and 7 show the experimental results when the horizontal width of at least one of the focusing electrodes is about 100 μm and a current caused by the anode voltage of is 50 μA.

Figure 6:
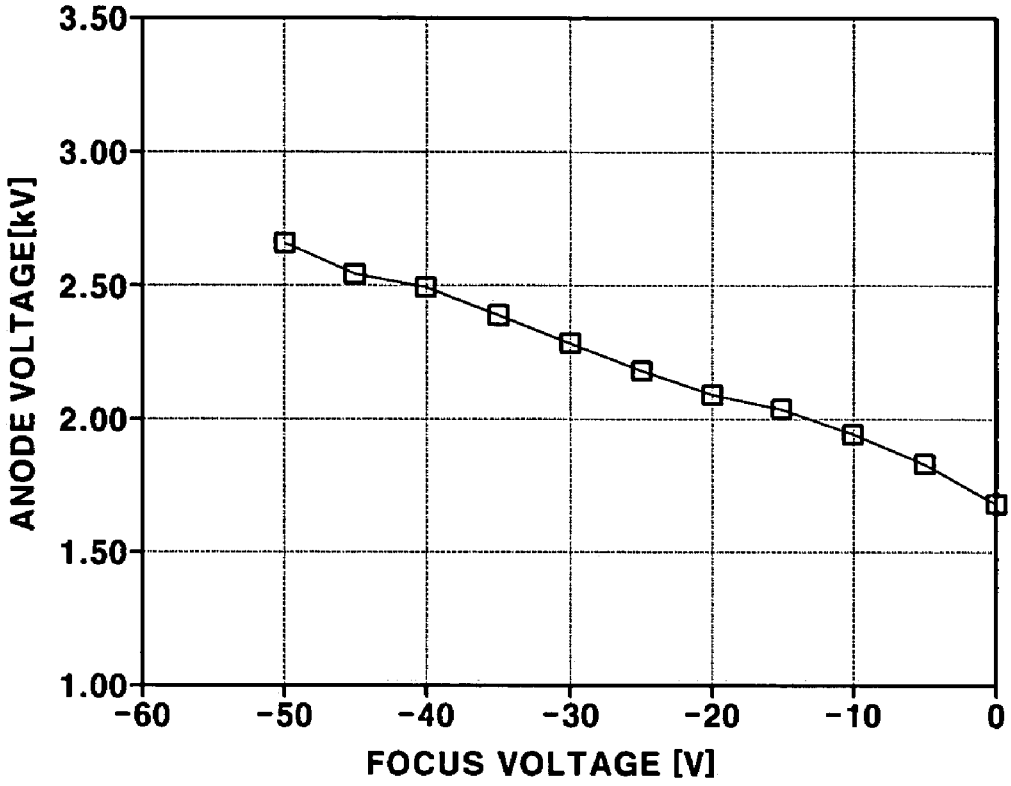
FIG. 6 is a graph showing the anode voltage causing a diode emission in response to a voltage applied to a focusing electrode in a driving method according to the first embodiment of the present invention.

In more detail, FIG. 6 is a graph showing the anode voltage causing a diode emission in response to a voltage applied to the focusing electrode (e.g., the electrode Fn) in a driving method according to the first embodiment of the present invention. In FIG. 6, the off-voltage of the scan signal is set to 0 V.

As can be seen from FIG. 6, the anode voltage causing a diode emission increases with an increase in the voltage applied to the focusing electrode Fn in the negative direction. For example, the voltage that can be applied to the anode electrode 40 is about 2.1 kV with a voltage of about −20 V applied to the focusing electrode Fn, and about 2.3 V with a voltage of about −30 V applied to the focusing electrode Fn.

Figure 7:
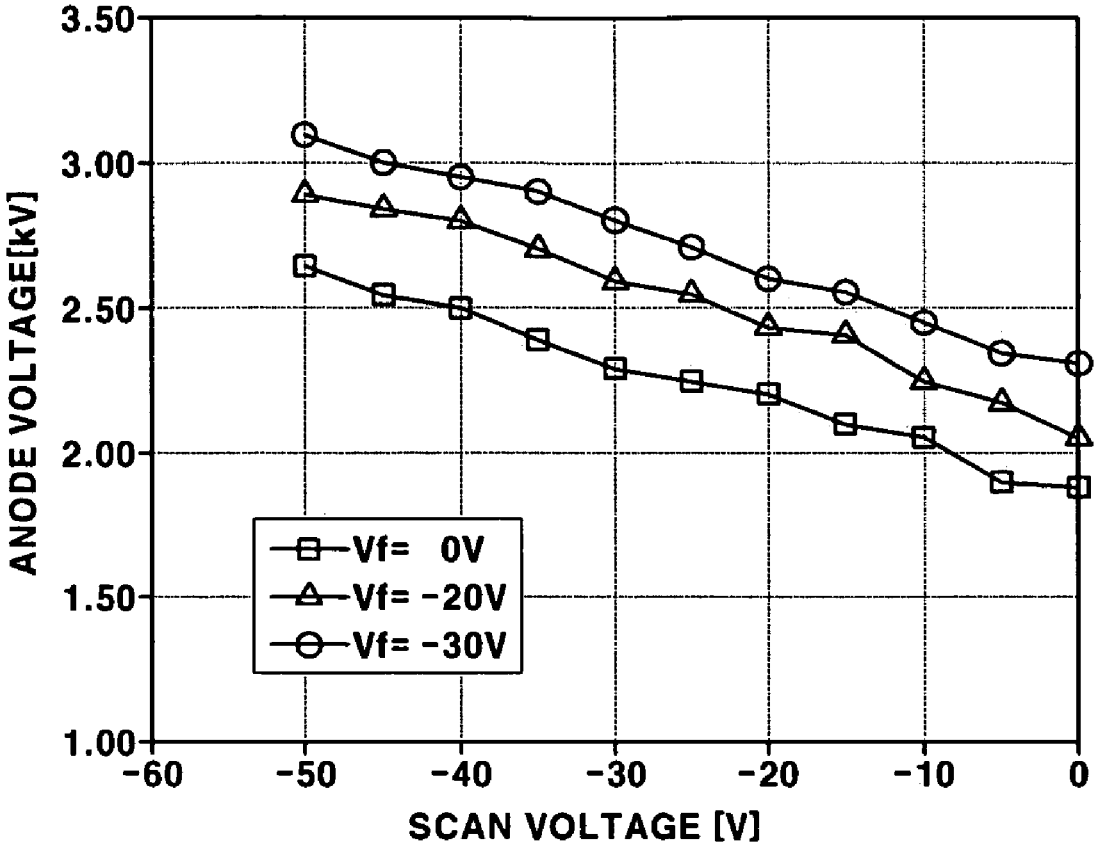
FIG. 7 is a graph showing the anode voltage causing a diode emission in response to a voltage applied to a focusing electrode and an off-voltage of a scan signal (e.g., applied to one or more scan electrodes of unselected pixels) in a driving method according to the second embodiment of the present invention.

FIG. 7 is a graph showing the anode voltage causing a diode emission in response to a voltage Vf applied to the focusing electrode (e.g., the electrode Fn) and an off-voltage (e.g., a voltage V3) of the scan signal (e.g., applied to one or more scan electrodes S1 to Sn of unselected pixels) in a driving method according to the second embodiment of the present invention.

As can be seen from FIG. 7, the anode voltage causing a diode emission increases with an increase in the voltage Vf applied to the focusing electrode Fn in the negative direction. In addition, the anode voltage causing a diode emission increases much more with an increase in the off-voltage of the scan signal in the negative direction.

For example, the voltage of about 2.7 kV can be applied to the anode electrode 40 when the voltage Vf applied to the focusing electrode Fn is about −20 V and the off-voltage of the scan signal is about −40 V. In addition, the voltage of about 2.9 kV can be applied to the anode electrode 40 when the voltage Vf applied to the focusing electrode Fn is about −30 V with the off-voltage of the scan signal being about −40 V.

As such, in accordance with the second embodiment of the present invention, the focusing electrodes are used to focus the electron beam of selected pixels to enable a first shielding of the anode field of the pixels. And, the voltage applied to the scan electrodes of unselected pixels is set lower than the voltage applied to the data electrodes to achieve a second shielding of the anode field.

While this invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An electron emission device comprising:

a first electrode having a data signal applied thereto, the data signal having an on-voltage and an off-voltage;

a second electrode having a scan signal applied thereto, the scan signal having an on-voltage and an off-voltage; and an electron emitter for emitting electrons in response to a voltage difference between the data signal and the scan signal, wherein in a first interval for applying the on-voltage of the data signal to the first electrode and the on-voltage of the scan signal to the second electrode, the first electrode and the second electrode are configured with the electron emitter to emit electrons, wherein in a second interval for applying the off-voltage of the data signal to the first electrode and the on-voltage of the scan signal to the second electrode, the first electrode and the second electrode are configured to interrupt electron emission of the electron emitter, wherein in a third interval for applying the on-voltage of the data signal to the first electrode and the off-voltage of the scan signal to the second electrode, the second electrode is configured to shield the electron emitter from an anode voltage, wherein the on-voltage of the scan signal is greater than the on-voltage of the data signal, and wherein the off-voltage of the scan signal is less than the on-voltage of the data signal.

2. The electron emission device as claimed in claim 1, wherein the on-voltage of the scan signal is a positive voltage, and wherein the off-voltage of the scan signal is a negative voltage.

3. The electron emission device as claimed in claim 2, wherein the on-voltage of the data signal is substantially equal to a ground voltage, and wherein the off-voltage of the data signal is a positive voltage.

4. The electron emission device as claimed in claim 1, wherein the on-voltage of the data signal is substantially equal to a ground voltage, and wherein the off-voltage of the data signal is a positive voltage.

5. The electron emission device as claimed in claim 1, further comprising:

a third electrode having a focusing signal applied thereto for focusing electrons emitted from the electron emitter.

6. The electron emission device as claimed in claim 5, wherein the focusing signal is set to have a negative voltage.

7. The electron emission device as claimed in claim 5, wherein the first electrode comprises a cathode electrode, the second electrode comprises a first gate electrode formed over the first electrode with a first insulating layer interposed between the first gate electrode and the first electrode, and the third electrode comprises a second gate electrode formed over the second electrode with a second insulating layer interposed between the second gate electrode and the second electrode.

8. The electron emission device as claimed in claim 7, further comprising:

a second substrate having a fourth electrode for attracting electrons emitted from the electron emitter, and a phosphor formed thereon for displaying an image when collided with electrons emitted from the electron emitter.

9. The electron emission device as claimed in claim 8, wherein the fourth electrode is an anode electrode formed with the phosphor.

10. The electron emission device as claimed in claim 8, wherein the third electrode is located between the first electrode and the fourth electrode.

11. An electron emission device comprising:

a panel including a first substrate having a plurality of scan and data electrodes arranged to cross over with each other and an electron emitter formed therewith, and a second substrate having at least one anode electrode formed therewith;

a data driver for applying data signals having first and second voltages to the data electrodes; and a scan driver for applying a third voltage to selected ones of the scan electrodes and a fourth voltage to unselected ones of the scan electrodes, wherein:

in a first interval for applying the first voltage to one of the data electrodes and the third voltage to a selected one of the scan electrodes, the one of the data electrodes and the selected one of the scan electrodes are configured with the electron emitter to emit electrons, in a second interval for applying the second voltage to the one of the data electrodes and the third voltage to the selected one of the scan electrodes, the one of the data electrodes and the selected one of the scan electrodes are configured to interrupt electron emission of the electron emitter, in a third interval for applying the first voltage to the one of the data electrodes and the fourth voltage to the selected one of the scan electrodes, the selected one of the scan electrodes is configured to shield the electron emitter from a voltage of the anode electrode, the third voltage is greater than the first voltage by a reference voltage, and the fourth voltage is less than the first voltage.

12. The electron emission device as claimed in claim 11, further comprising:

at least one focusing electrode formed with the first substrate for focusing the electrons emitted from the electron emitter and shielding an electric field of the anode electrode.

13. The electron emission device as claimed in claim 11, further comprising:

a phosphor formed with the second substrate for displaying an image when collided with electrons.

14. The electron emission device as claimed in claim 11, wherein the fourth voltage has a negative voltage level.

15. A method for driving an electron emission device, which includes a first substrate having at least one anode electrode formed therewith, and a second substrate having a plurality of first electrodes, a plurality of second electrodes with an electron emitter formed thereon, and a third electrode formed over the first electrodes, the method comprising:

selecting one of the first electrodes to apply a first voltage in a first interval and a second voltage in a third interval;

applying a fourth voltage to one of the second electrodes and the first voltage to the selected one of the first electrodes in the first interval and emitting electrons from the electrode emitter in the first interval;

applying a fifth voltage to the one of the second electrodes and the first voltage to the selected one of the first electrodes in a second interval and interrupting emission of the electrons from the electron emitter in the second interval, the second interval being after the first interval and before the third interval;

applying the fifth voltage to the one of the second electrodes and the second voltage to the selected one of the first electrodes in the third interval and shielding an electric field of the anode electrode in the third interval; and applying a third voltage to the third electrode during the first, second, and third intervals, the second voltage being set to a voltage level for causing the selected one of the first electrodes to shield the electric field of the anode electrode in the third interval, the first voltage being greater than the fourth voltage, and the second voltage being less than the fourth voltage.

16. The method as claimed in claim 15, wherein the second voltage is a negative voltage.

17. The method as claimed in claim 15, wherein the third voltage is a negative voltage.

18. The method as claimed in claim 17, wherein the second voltage is a negative voltage.

19. The method as claimed in claim 15, wherein the fourth voltage is a data voltage.

20. An electron emission device comprising:

a first electrode;

a second electrode; and an electron emitter, wherein:

in a first interval for applying an on-voltage of a data signal to the first electrode and an on-voltage of an scan signal to the second electrode, the first electrode and the second electrode are configured with the electron emitter to emit electrons, in a second interval for applying an off-voltage of the data signal to the first electrode and the on-voltage of the scan signal to the second electrode, the first electrode and the second electrode are configured to interrupt electron emission of the electron emitter, and in a third interval for applying the on-voltage of the data signal to the first electrode and an off-voltage of the scan signal to the second electrode, the second electrode is configured to shield the electron emitter from an anode voltage, and wherein:

the on-voltage of the scan signal is greater than the on-voltage of the data signal, and the off-voltage of the scan signal is less than the on-voltage of the data signal.

* * * * *